US006692288B2

(12) United States Patent
Nimura

(10) Patent No.: US 6,692,288 B2
(45) Date of Patent: Feb. 17, 2004

(54) CONNECTOR WITH DETECTOR FOR DETECTING INCOMPLETE CONNECTION AND FOR PROTECTING RESILIENT LOCK ARM OF CONNECTOR

(75) Inventor: Kazuhiko Nimura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/287,897

(22) Filed: Nov. 4, 2002

(65) Prior Publication Data

US 2003/0087545 A1 May 8, 2003

(30) Foreign Application Priority Data

Nov. 7, 2001 (JP) ..... 2001-342259

(51) Int. Cl.[7] ..... H01R 13/627; H01R 3/00
(52) U.S. Cl. ..... 439/352; 439/489
(58) Field of Search ..... 439/489, 488, 439/352, 353, 354, 357, 358

(56) References Cited

U.S. PATENT DOCUMENTS 5,217,390 A 6/1993 Nozaki et al. ..... 439/489
5,879,180 A * 3/1999 Iwahori et al. ..... 439/352
5,910,028 A * 6/1999 Tsuji ..... 439/489
5,997,344 A * 12/1999 Shinozaki ..... 439/489
6,443,760 B2 * 9/2002 Hasegawa ..... 439/489
2003/0049959 * 3/2003 Yamashita ..... 439/352

* cited by examiner

*Primary Examiner*—Chandrika Prasad
(74) *Attorney, Agent, or Firm*—Anthony J. Casella; Gerald E. Hespos

(57) ABSTRACT

A movement of a detector (30) to a detecting position is prevented by the engagement of a resilient locking piece (32) with a stopper (17) in a partly connected state of a first connector (F) and a second connector (M), whereas the resilient locking piece (32) is disengaged from the stopper (17) to permit the movement of the detector (30) to the detecting position in a properly connected state of the connectors (F, M). Thus, a connected state of the connectors (F, M) can be detected based on whether the detector (30) can be moved to the detecting position. The detector (30) covers the outer surface of the lock arm (14). Hence, external matter will not interfere with the lock arm (14).

10 Claims, 5 Drawing Sheets

CONNECTOR WITH DETECTOR FOR DETECTING INCOMPLETE CONNECTION AND FOR PROTECTING RESILIENT LOCK ARM OF CONNECTOR

BACKGROUND OF THE INVENTION

1. Field of the Invention

The present invention relates to a connector and to a connector assembly provided with a connection detecting function.

2. Description of the Related Art

U.S. Pat. No. 5,217,390 discloses a connector assembly with a housing and a lock arm. The lock arm deflects into a deformation permitting space when the connector is connected partly, but then returns to an undeflected position and out of the deformation permitting space when the connector is connected fully. The connector assembly also has a detector that is movable between a standby position outside the deformation permitting space and a position in the deformation permitting space. The lock arm prevents the detector from entering the deformation permitting space when the connector is in a partly connected state. However, the detector can enter the deformation permitting space when the connector is in a fully connected state because the lock arm has returned resiliently to a location outside the deformation permitting space. Thus, the connected state can be detected based on whether the detector can enter the deformation permitting space.

The lock arm of the above described prior art connector assembly is exposed to the outside along the outer surface of the connector housing so that a finger can contact and unlock the lock arm. A moving path of the detector including the deformation permitting space is provided between the inner surface of the lock arm and the outer surface of the connector housing so as not to hinder the unlocking operation. However, a lock arm that is exposed to outside may be damaged by external matter.

The invention was developed in view of the above problem and an object thereof is to improve connection detection.

SUMMARY OF THE INVENTION

The invention is directed to a connector that is connectable with a mating connector. The connector comprises a housing into which at least one terminal fitting is insertable. A lock arm is formed on the housing and is inclinable with respect to the housing as the connector is being connected with the mating connector. The connector also has a detector that is movable between a standby position and a detecting position. Movement of the detector from the standby position to the detecting position is prevented in a partly connected state of the two connectors. However, movement of the detector to the detecting position is permitted in a fully connected state of the connectors. The detector is mounted on the lock arm for sliding movement between the standby position and the detecting position and is inclinable together with the lock arm. The detector is formed with a resilient locking piece, and the lock arm has a stopper that engages the resilient locking piece for preventing the detector at the standby position from moving toward the detecting position. The resilient locking piece is configured so as not to interfere with a freeing portion of the mating connector in the partly connected state of the connectors. Additionally, the resilient locking piece contacts the freeing portion and deforms resiliently to disengage from the stopper, thereby permitting the detector to move to the detecting position in the fully connected state of the connectors.

The resilient locking piece engages the stopper when the connectors are connected partly to prevent the detector from moving to the detecting position. However, the resilient locking piece is disengaged from the stopper when the connectors are connected properly, and the detector can be moved to the detecting position. Thus, the connected state of the connectors is detected based on whether the detector can be moved to the detecting position.

The detector is inclined together with the lock arm, and hence does not hinder the inclination of the lock arm during connection or unlocking.

The detector and the lock arm incline together. Thus connection detection cannot be made based on whether the detector directly interferes with the lock arm. However, at the time of the proper connection, the resilient locking piece in the detector contacts the freeing portion of the second connector, and is displaced to permit movement of the detector to the detecting position, as the lock arm makes a returning movement. Thus, the detection by the detector is linked with the inclination of the lock arm.

The detector covers the outer surface of the locking arm at all positions between the standby position and the detecting position. Accordingly, interference by external matter with a lock arm can be prevented.

The resilient locking piece and the lock arm preferably interact such that a resilient force of the resilient locking piece displaces the lock arm in an unlocking direction.

The invention also is directed a connector assembly with first and second connectors that are connectable with each other. The first connector is the connector described above and the second connector comprises a freeing portion. The resilient locking piece does not interfere with the freeing portion in the partly connected state of the two connectors. However, the resilient locking piece contacts the freeing portion and is deformed resiliently to disengage from the stopper, thereby permitting the movement of the detector to the detecting position in the fully connected state of the two connectors.

The freeing portion preferably comprises a lock projection for locking with the lock arm in the properly connected state of the two connectors. Thus, the construction of the second connector can be simpler as compared to a case where the freeing portion and the lock projection are separate.

The connector assembly further comprises an inclination-restricting portion for preventing the detector and the lock arm from inclining in an unlocking direction by engaging the detector at the detecting position and for permitting the detector to incline as the detector is moved to the standby position. The inclination-restricting portion preferably is in the first connector, and it is not necessary to provide the second connector M with such a means.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
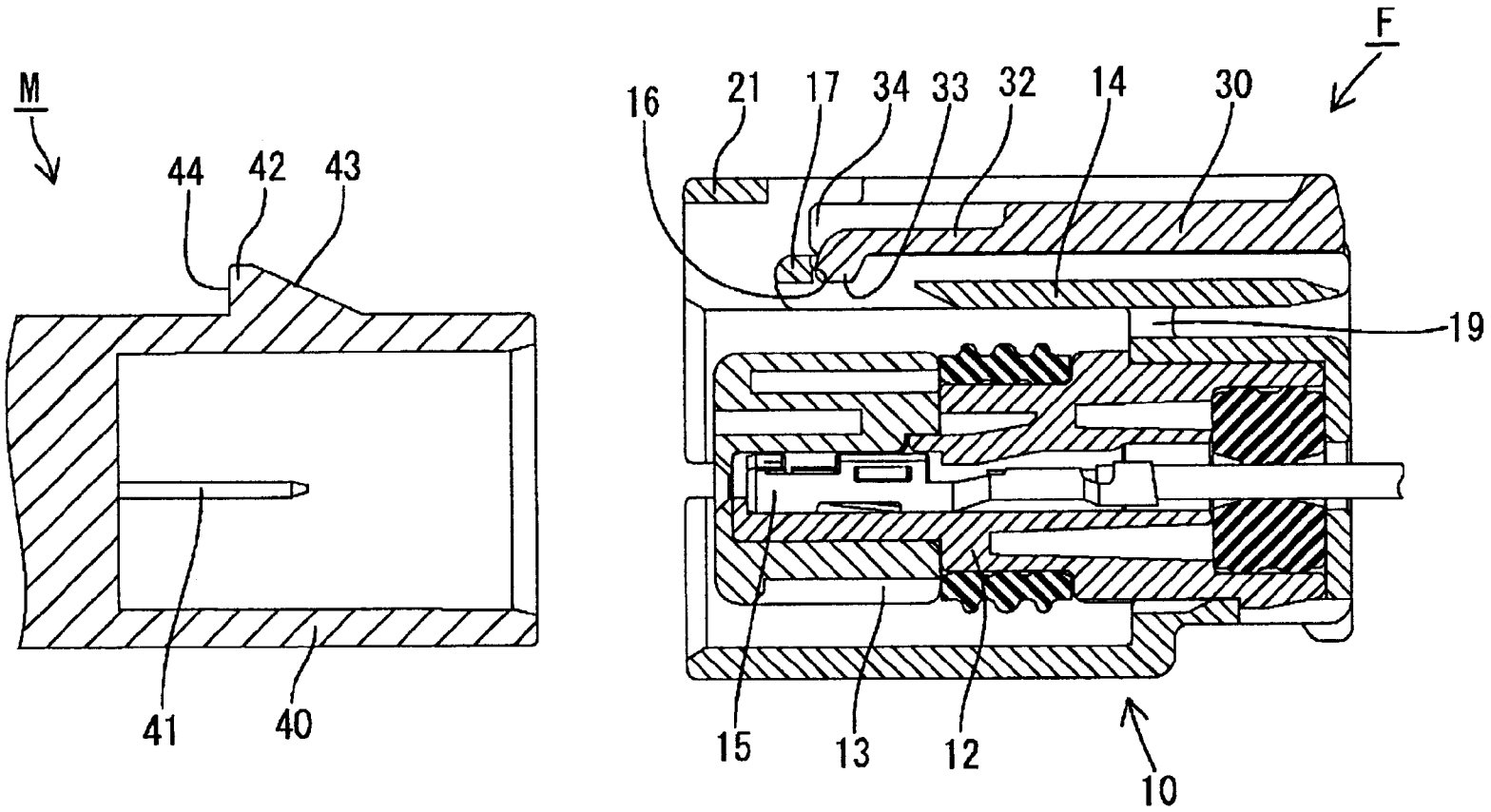
FIG. 1 is a section showing a state where a first connector and a second connector are separated in one embodiment of the invention.

A connector assembly according to the invention includes a first connector F and a second connector M that are connectable with each other. Mating sides of the two connectors F, M are referred to as the forward sides in the following description. The first connector F includes a housing 10 into which terminal fittings 15 are insertable, and a detector 30. The housing 10 has a main portion 12 in which the terminal fittings 15 are accommodated. A tube 13 substantially surrounds the front of the main portion 12 and has an open front end. A lock arm 14 is formed on an upper outer surface of the main portion 12.

The lock arm 14 of the housing 10 extends substantially in forward and backward directions along the upper surface of the main portion 12 of the housing 10, and is supported on the upper surface of the main portion 12 substantially at a longitudinal center position. A lock hole 16 penetrates a front portion of the lock arm 14 vertically from the upper surface to the lower surface, and the portion of the lock arm 14 forward of the lock hole 16 defines a stopper 17. Guide ribs 18 are formed at the lateral sides of the lock arm 14 and extend in forward and backward directions substantially parallel with the longitudinal direction of the lock arm 14. The lock arm 14 normally is in a locking posture substantially parallel with the upper surface of the main portion 12, and is resiliently inclinable like a seesaw about a support 19 to take an unlocking posture where the stopper 17 at the front end is displaced up away from the upper surface of the main portion 12.

Figure 7:
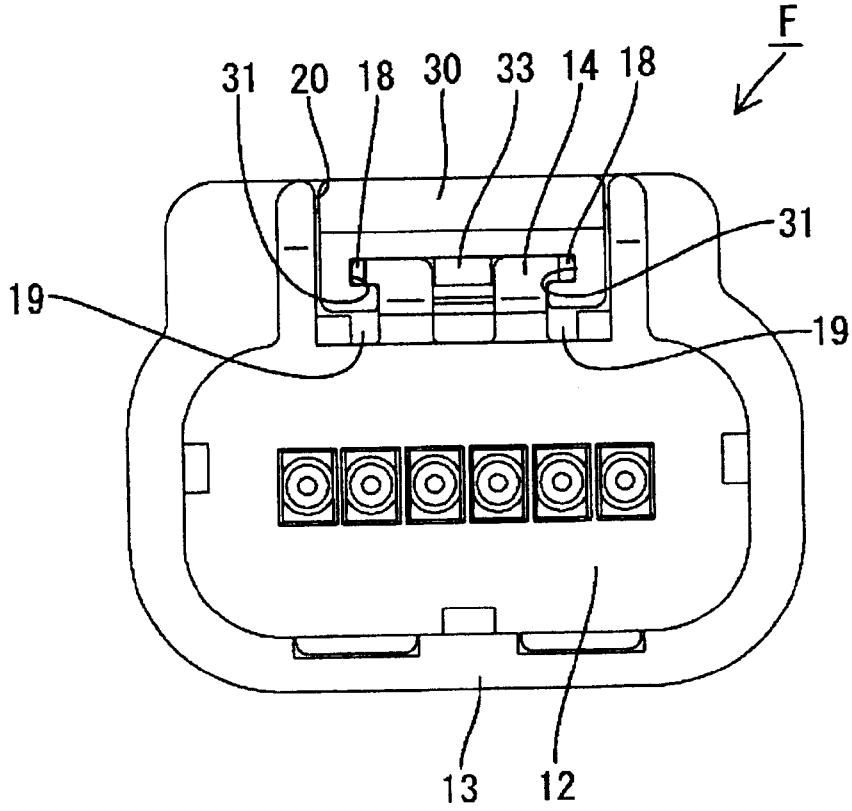
FIG. 7 is a rear view of the first connector.

The upper wall of the tube 13 is formed with a notch 20 (FIG. 7) for enabling the lock arm 14 and the detector 30 to be operated from above for unlocking and connection detection. A portion of the upper wall of the tube 13 near the front end of the notch 20 serves as an inclination-preventing portion 21 for restricting the lock arm 14 from being unlocked.

The detector 30 is a substantially rectangular plate, and guide grooves 31 extend forward and backward at locations inward from the lateral sides of the bottom surface of the detector 30. A resilient locking piece 32 is formed by left and right slits that extend back from the front end of the detector 30. Thus, the resilient locking piece 32 is cantilevered forward and is resiliently deformable in the vertical direction. A lock 33 projects down at the front of the resilient locking piece 32. The resilient locking piece 32 normally has a locking posture where the lock 33 is substantially at the same height as the stopper 17, and is resiliently inclinable to a posture where the lock 33 is above the stopper 17. Front portions of the detector 30 at opposite sides of the resilient locking piece 32 serve as restrictable portions 34. Upper surfaces of the restrictable portions 34 are slightly below the bottom surface of the inclination-restricting portion 21 when the lock arm 14 is in its locking posture and are higher than the upper surface of the resilient locking piece 32 in its locking posture.

The detector 30 is mounted on the lock arm 14 with the bottom surface of the detector 30 held substantially in contact with the upper surface of the lock arm 14 and with the guide ribs 18 fitted in the guide grooves 31 without shaking along vertical and transverse directions. Engagement of the guide ribs 18 and the guide grooves 31 enables the detector 30 to slide along the lock arm 14 in substantially forward and backward directions between a standby position and a detecting position forward from the standby position. Thus, the detector 30 is inclinable together with the lock arm 14. Additionally the resilient locking piece 32 is independently inclinable with respect to the lock arm 14.

Figure 2:
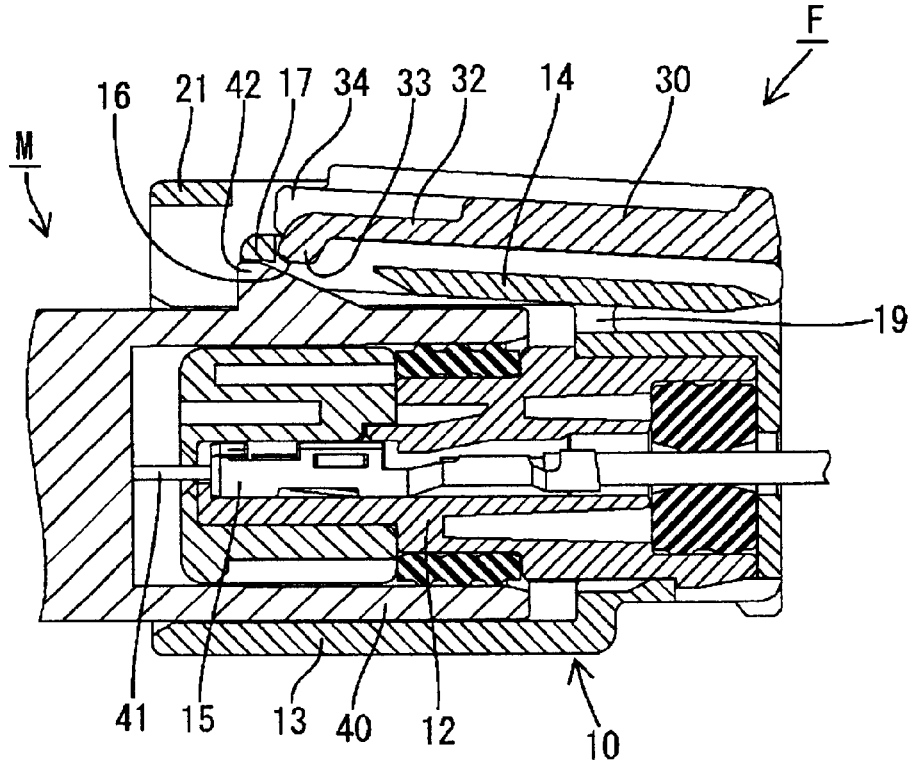
FIG. 2 is a section showing the two connectors partly connected.

The lock 33 is in the lock hole 16 and engaged with the stopper 17 from behind when the lock arm 14 is in the locking posture and when the detector 30 is at the standby position, as shown in FIG. 1. Additionally the restrictable portions 34 and the resilient locking piece 32 are retracted back from the inclination-restricting portion 21 in the standby position of FIG. 1. The lock 33 is engaged with the stopper 17 from behind in this state. Thus, the detector 30 is prevented by the stopper 17 from sliding forward toward the detecting position with respect to the lock arm 14. The resilient locking piece 32 can be deformed up to a moving-over posture, as shown in FIG. 2, so that the detector 30 can be moved forward to the detecting position.

Figure 4:
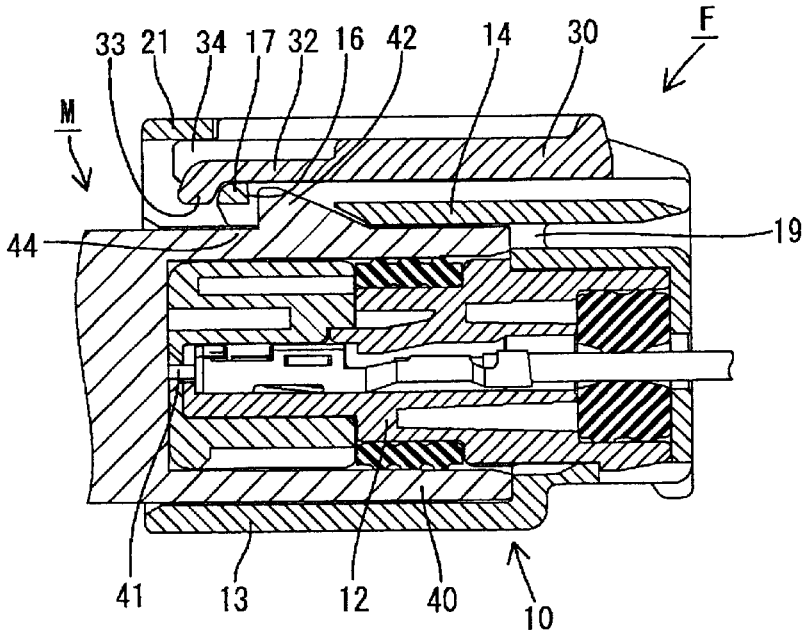
FIG. 4 is a section showing the two connectors locked in their properly connected state and a detecting member at a detecting position.

The lock 33 is outside the lock hole 16 and engaged with the stopper 17 from the front when the lock arm 14 is in the locking posture and the detector 30 is at the detecting position shown in FIG. 4. Additionally, the restrictable portions 34 engage with the inclination-restricting portion 21 from below, as shown in FIG. 4. The lock 33 is engaged with the stopper 17 from the front in this state. Thus, the stopper 17 prevents the detector 30 from moving back toward the standby position. However, a backward-acting force may be exerted on the detector 30 in excess of a locking force between the lock 33 and the stopper 17. Hence, the resilient locking piece 32 will deform to the moving-over posture and the slanted rear surface of the lock 33 will slide in contact with the slanted front surface of the stopper 17. This outward deformation is assisted by the slanted or rounded surfaces of the stopper 17 and the lock 33. Thus, the detector 30 is free to move.

The detector 30 is longer and wider than the lock arm 14. Thus, the detector 30 covers substantially the entire upper surface of the lock arm 14 at all positions in the movable range between the standby and detecting positions.

The second connector M has a forwardly projecting receptacle 40, and (male) terminal fittings 41 project into the receptacle 40. The second connector M is connected with the first connector F by fitting the receptacle 40 between the main portion 12 and the tube 13 of the first connector F. A lock projection 42 is formed on the upper surface of the receptacle 40 and faces the lower surface of the lock arm 14 in a connected state of the two connectors F, M. The front of the lock projection 42 is an upwardly and rearwardly slanted guide surface 42, and the rear thereof defines a locking surface 44 aligned substantially normal to the connecting directions of the two connectors F, M.

The lock projection 42 enters the lock hole 16 of the lock arm 14 from below to engage the locking surface 44 with the stopper 17 when the two connectors F, M are connected properly with each other to lock the two connectors F, M in a properly connected condition.

The detector 30 is held at the standby position before the two connectors F, M are connected. The stopper 17 at the front end of the lock arm 14 contacts the slanted guide surface 43 of the lock projection 42 when the connection of the two connectors F, M is started. Thus, the lock arm 14 is inclined resiliently from the locking posture to the unlocking posture while the stopper 17 slides on the slanted guide surface 43, and the detector 30 is inclined together with the lock arm 14 while being held at the standby position.

The stopper 17 remains on the lock projection 42 if the two connectors F, M are left partly connected. Accordingly, the lock 33 of the resilient locking piece 32 of the detector 30 does not contact the lock projection 42 (see FIG. 2). Since the resilient locking piece 32 is kept engaged with the stopper 17 from behind, the detector 30 still is held at the standby position. Thus, the detector 30 cannot be slid to the detecting position in the partly connected state of the two connectors F, M. The detector 30 is inclined together with the lock arm 14 in this partly connected state. Hence, the partly connected state of the two connectors F, M can be observed and detected.

The stopper 17 passes the lock projection 42 and the lock 33 of the resilient locking piece 32 substantially faces the upper surface of the lock projection 42 when the two connectors F, M are connected properly. Thus, the stopper 17 disengages from the lock projection 42 and the lock arm 14 resiliently returns from the unlocking posture to the locking posture by its resilient restoring force. The detector 30 also returns toward its horizontal posture together with the lock arm 14. As the detector 30 returns to its horizontal posture, the resilient locking piece 32 having the lock 33 held in contact with the upper surface of the lock projection 42 is deformed resiliently upward with respect to the detector 30 to reach its moving-over posture (see FIG. 3). In other words, the resilient locking piece 32 is moved up with respect to the stopper 17 and allows an axial movement of the resilient locking piece 32 with respect to the stopper 17 toward the detecting position. Consequently, the lock 33 is disengaged upward from the stopper 17, and frees the detector 30 to move to the detecting position.

The lock 33 moves from the upper surface of the lock projection 42 onto the upper surface of the stopper 17 while the detecting member 30 is slid to the detecting position. Simultaneously, the resilient locking piece 32 is held in the moving-over posture. When the detector 30 reaches the detecting position, the lock 33 passes the stopper 17 and the resilient locking piece 32 resiliently returns toward the locking posture (see FIG. 4). Thus, the lock 33 engages the stopper 17 from the front and prevents the detector 30 from moving loosely in a return direction toward the standby position. At the detecting position, the restrictable portions 34 at the front end of the detector 30 engage the inclination restricting portion 21 from below, thereby preventing the detector 30 from inclining in a direction to lift the front end thereof. Specifically, the lock arm 14 inclinable together with the detector 30 also is prevented from inclining from the locking posture to the unlocking posture. Thus, the lock arm 14 and the lock projection 42 are held securely with each other, and the two connectors F, M are locked securely in their properly connected state.

Figure 3:
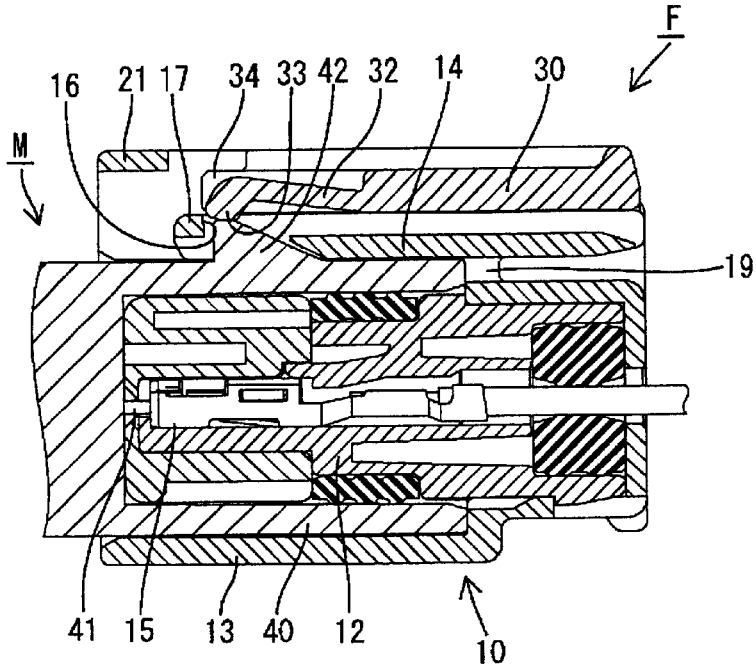
FIG. 3 is a section showing the two connectors properly connected.
Figure 5:
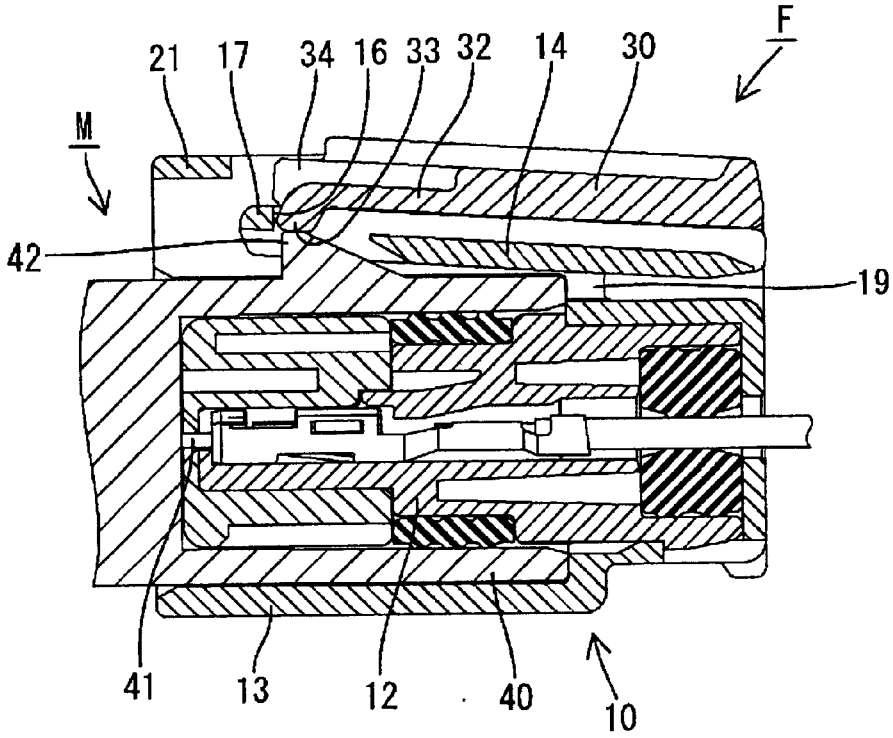
FIG. 5 is a section showing a state where unlocking is effected for the two connectors.
Figure 6:
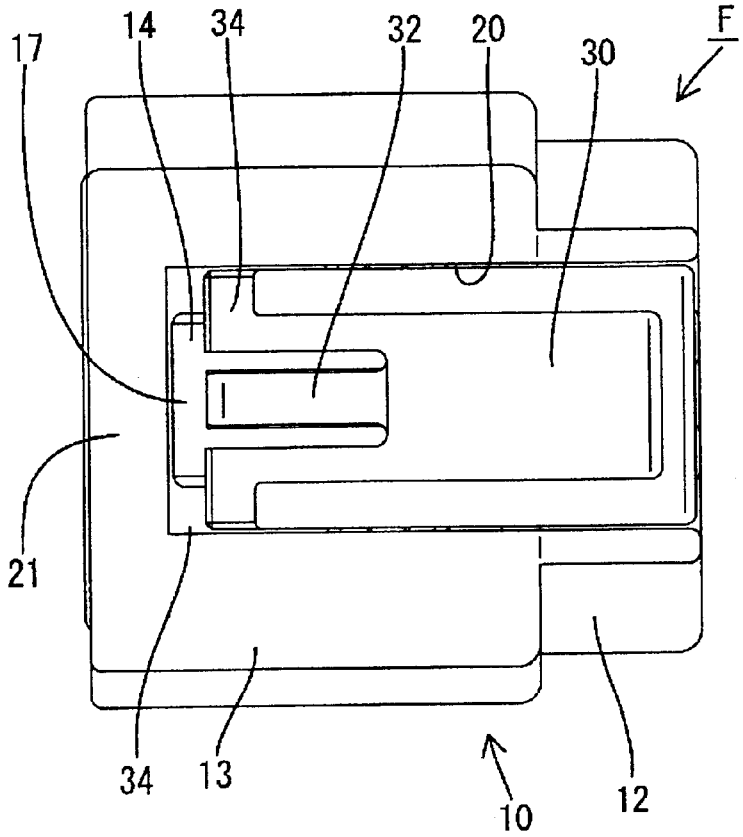
FIG. 6 is a plan view of the first connector.

The two locked connectors F, M are separated by first sliding the detector 30 to the standby position located back from the second connector M. The rearward movement of the detector 30 releases the lock 33 from the front end of the stopper 17, and enables the lock 33 to move over and back from the stopper 17. Then, as shown in FIG. 3, the lock 33 moves onto the upper surface of the lock projection 42 and the restrictable portions 34 are disengaged backward from the inclination-restricting portion 21 while the resilient locking piece 32 is deformed resiliently to reach the moving-over posture. The lock arm 14 is permitted to incline to the unlocking posture together with the detector 30 after being disengaged from the inclination-restricting portion 21. When the rear end of the detector 30 is pushed down in this state, the lock arm 14 and the detector 30 incline together to a height that permits the stopper 17 to move beyond the lock projection 42. As a result, unlocking is effected for the two connectors F, M (see FIG. 5). At this time, the resilient restoring force of the resilient locking piece 32 acts to displace the lock arm 14 in an unlocking direction from the locking surface 44. Thus, an operation force to incline the lock arm 14 can be reduced. Thereafter, the two connectors F, M are pulled apart while the lock arm 14 and the detector 30 are kept inclined.

As described above, the outer surface of the lock arm 14 is covered substantially entirely by the detector 30 at all positions of the detector 30 between the detecting position and the standby position. Thus, interference of external matter with the lock arm 14 can be prevented.

The detector 30 inclines together with the lock arm 14, and does not hinder the operation of inclining the lock arm 14 during the connection of the two connectors F, M or during unlocking.

The detector 30 and the lock arm 14 are inclined together in this embodiment. Thus, connection detection cannot be made based on whether the detector 30 directly interferes with the lock arm 14. However, at the time of the proper connection, the resilient locking piece 32 in the detector 30 contacts the lock projection 42 as the freeing portion of the second connector M, and resiliently displaces to permit movement of the detector 30 to the detecting position, as the lock arm 14 makes a returning movement. Thus, the detection by the detector 30 linked with the inclination of the lock arm 14 can be realized.

The lock projection 42 also serves as the freeing portion for freeing and permitting the detector 30 for movement to the detecting position. Thus, the construction of the second connector M can be simpler as compared to a case where the freeing portion and the lock projection are separate.

The means for preventing the lock arm 14 from inclining in the unlocking direction is formed only by the inclination-restricting portion 21 in the first connector F and the detector 30. Thus, it is not necessary to provide the second connector M with such a means.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The freeing portion also is the lock projection in the foregoing embodiment. However, the freeing portion and the lock projection may be separate according to the present invention.

The inclination-restricting portion is the means for preventing the lock arm from inclining in the unlocking direction and is provided in the first connector in the foregoing embodiment. However, it may be provided in the second connector according to the present invention.

What is claimed is:

1. A connector connectable with a mating connector, the mating connector being formed with a freeing portion projecting outwardly from an external surface of the mating connector, the connector comprising:

a housing for receiving at least one terminal fitting, a lock arm formed on the housing and being relatively inclinable with respect to the housing during connection of the connector with the mating connector, a stopper being formed on the lock arm and being configured for sliding outwardly and over the freeing portion and for locked engagement with freeing portion when the connector is fully connected with the mating connector;

a detector mounted on the lock arm for sliding movement between a standby position and a detecting position, the detector being configured for covering at least portions of the stopper when the detector is in the detecting position and being inclinable with the lock arm, a resilient locking piece being formed on the detector for engaging the stopper of the lock arm and preventing the detector from moving toward the detecting position, the resilient locking piece being configured so as not to interfere with the freeing portion of the mating connector in a partly connected state of the connectors, whereas the resilient locking piece contacts the freeing portion and deforms resiliently outwardly from the stopper in a fully connected state of the two connectors thereby permitting the movement of the detector to the detecting position;

whereby a fully connected state of the connector with the mating connector is detectable by an ability to move the detector to the detecting position.

2. The connector of claim 1, wherein the detector is dimensioned to substantially cover an entire outer surface of the lock arm in both the standby position and the detecting position.

3. The connector of claim 1, wherein the resilient locking piece and the locking arm interact such that a resilient force of the resilient locking piece acts as a force for displacing the lock arm in an unlocking direction.

4. The connector of claim 3, wherein the lock arm is formed with a lock hole, the stopper being adjacent and partly defined by the lock hole (16).

5. The connector of claim 4, wherein the resilient locking piece and the stopper are moved out of engagement as the detector is moved toward the standby position.

6. A connector assembly having a first connector and a second connector connectable with each other, the second connector being formed with a freeing portion projecting outwardly on an outer surface of the second connector, the first connector comprising:

a housing for receiving at least one terminal fitting, a lock arm formed on the housing and being relatively inclinable with respect to the housing during connection of the connector with the mating connector, a stopper being formed on the lock arm at a position for deflecting outwardly on the housing and over the freeing portion of the second connector; and a detector mounted on the lock arm for sliding movement between a standby position and a detecting position and being inclinable with the lock arm outwardly and over the freeing portion of the second connector, a resilient locking piece being formed on the detector for engaging the stopper of the lock arm and preventing the detector from moving toward the detecting position, the resilient locking piece being configured so as not to interfere with the freeing portion of the mating connector in a partly connected state of the connectors, whereas the resilient locking piece contacts the freeing portion and deforms resiliently outwardly from and over the stopper in a fully connected state of the two connectors thereby permitting the movement of the detector to the detecting position, whereby a fully connected state of the connector with the mating connector is detectable by an ability to move the detector to the detecting position.

7. The connector assembly of claim 6, wherein the freeing portion comprises a lock projection for locking the two connectors in their connected state by being engaged with the lock arm in the properly connected state of the two connectors.

8. The connector assembly of claim 6, further comprising an inclination restricting portion for preventing the detector and the lock arm from inclining in an unlocking direction by engaging with the detector at the detecting position and for freeing the detecting member to incline as the detector is moved to the standby position.

9. The connector assembly of claim 8, wherein the inclination restricting portion is provided on the housing of the first connector.

10. The connector of claim 1, further comprising an inclination restricting portion for preventing the detector and the lock arm from inclining in an unlocking direction by engaging with the detector at the detecting position and for freeing the detecting member to incline as the detector is moved to the standby position.

* * * * *